US006923534B2

(12) United States Patent
Sai

(10) Patent No.: US 6,923,534 B2
(45) Date of Patent: Aug. 2, 2005

(54) INK TYPE RECORDING DEVICE AND METHOD FOR CLEANING CONTROL OF THE SAME

(75) Inventor: Noriyuki Sai, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/232,835

(22) Filed: Sep. 3, 2002

(65) Prior Publication Data

US 2003/0052953 A1 Mar. 20, 2003

(30) Foreign Application Priority Data

Sep. 4, 2001 (JP) ..... 2001-267926

(51) Int. Cl.[7] ..... B41J 2/01

(52) U.S. Cl. ..... 347/104; 347/101; 101/416.1; 400/701

(58) Field of Search ..... 347/104, 171, 347/221, 101; 101/425, 416.1, 417, 419; 83/264, 263; 400/701, 702; 226/1

(56) References Cited

U.S. PATENT DOCUMENTS 5,706,078 A * 1/1998 Cesa et al. ..... 355/72
5,926,197 A * 7/1999 Kessler ..... 347/171
6,170,943 B1 * 1/2001 Wen et al. ..... 347/101
6,271,872 B1 * 8/2001 Nagata ..... 347/171
6,334,677 B1 * 1/2002 Wen et al. ..... 347/101
6,517,190 B2 * 2/2003 Matsumoto et al. ..... 347/35
6,592,217 B2 * 7/2003 Tanaami ..... 347/104

FOREIGN PATENT DOCUMENTS

EP 816077 A1 * 1/1998 ..... B41F/35/00
JP 60049985 A * 3/1985 ..... B41J/29/00
JP 2001302074 A * 10/2001 ..... B65H/35/06

* cited by examiner

*Primary Examiner*—Manish Shah
*Assistant Examiner*—Leonard Liang
(74) *Attorney, Agent, or Firm*—Sughrue Mion, PLLC

(57) ABSTRACT

The printer moves printing paper (12) toward an ejecting direction and a feeding direction in order to clean a notched rollers (28). Next, the printer moves the printing paper (12) toward the feeding direction under conditions where a cutting paper holder (60) is holding the tip portion of the printing paper (12) in order to clean the cutting paper holder (60). Next, the printer cuts off the tip portion of the printing paper (12) in a long rectangular shape in order to clean a cutting edge (54) of a cutter (50). Thereby, it is possible to clean the printer (ink type recording device) without a user's action.

30 Claims, 11 Drawing Sheets

INK TYPE RECORDING DEVICE AND METHOD FOR CLEANING CONTROL OF THE SAME

BACKGROUND OF THE INVENTION

1. Field of the Invention

This invention relates to an ink type recording device and a method for cleaning control of the same, and more particularly, to an ink type recording device which performs a cleaning operation by using a printing medium and a method for cleaning control of the same.

2. Description of the Related Art

An ink jet printer is one type of commonly used printer. The ink jet printer is a printer in which ink is spouted from nozzles of a print head to printing paper for producing a printed output. Such a printer is small and cheap, so that it is widely used for personal use and domestic use.

However, spouting the ink to the printing paper in the ink jet printer unavoidably makes problems. A roller which is used for moving the printing paper, a cutting edge of a cutter which cuts the printing paper at a predetermined position, and a cutting paper holder which holds the printing paper when it is cut by using the cutter are soiled with the ink.

As a result, it is necessary for users themselves to periodically clean off the roller, the cutting edge and the cutting paper holder with a cotton swab and so on. However, this cleaning operation is complicated and it is troublesome for the users. When the users have not performed this cleaning operation for a long time, the ink sticks to the roller, the cutting edge and the cutting paper holder and then it is impossible to remove the ink dirt through the cleaning operation with the cotton swab and so on.

Moreover, such problems arise not only in the ink jet printer but also in an ink type recording device which performs a printing operation to printing paper by using the ink.

SUMMARY OF THE INVENTION

It is therefore an object of the present invention to provide an ink type recording device capable of a cleaning operation of the roller which is used for moving a printing medium, the cutting edge of the cutter which cuts the printing medium and the cutting paper holder thereof and a method for cleaning control of the same.

In order to accomplish the aforementioned and other objects, according to one aspect of the present invention, an ink type recording device, comprising:

a printing medium mover which moves a printing medium toward a first direction and a second direction which is opposite to the first direction;

a print head which produces a printed output on the printing medium;

a cutter which is provided in the first direction side of the print head and which cuts the printing medium; and a cutter cleaning executor which moves the printing medium by using the printing medium mover so that the tip of the printing medium in the first direction is at a position of the cutter and which cuts the printing medium with the cutter at least once in order to clean the cutter.

According to another aspect of the present invention, a method for cleaning control of an ink type recording device which includes a print head for producing a printed output on a printing medium and a cutter which is provided in the first direction side of the print head and which cuts the printing medium, the method comprising the steps of:

moving the printing medium toward the first direction so that the tip of the printing medium in the first direction is at a position of the cutter; and cutting the printing medium at least once in order to clean the cutter.

DETAILED DESCRIPTION OF THE PREFERRED EMBODIMENTS

According to an embodiment of the present invention, when a user sets a new roll paper in an ink jet printer, the ink jet printer draws out the printing paper from the roll paper, cleans notched rollers with back-and-forth movement of printing paper around the notched rollers, and cleans a cutting paper holder with back movement of the printing paper under conditions where the cutting paper holder is holding the printing paper, and then cleans a cutting edge of a cutter with cutting the printing paper with the cutting edge. More detailed explanation will be made hereinafter.

Figure 1:
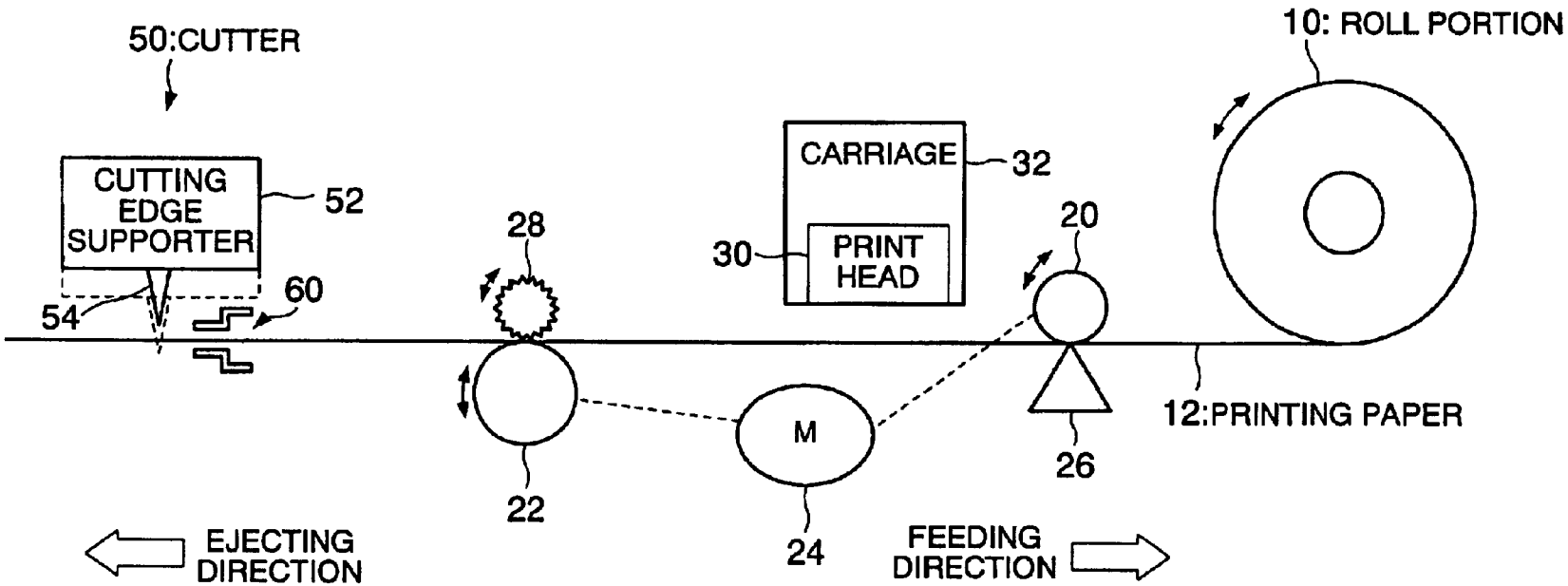
FIG. 1 is a schematic sectional view for explaining a paper feed mechanism of a printer according to an embodiment of the present invention.
Figure 2:
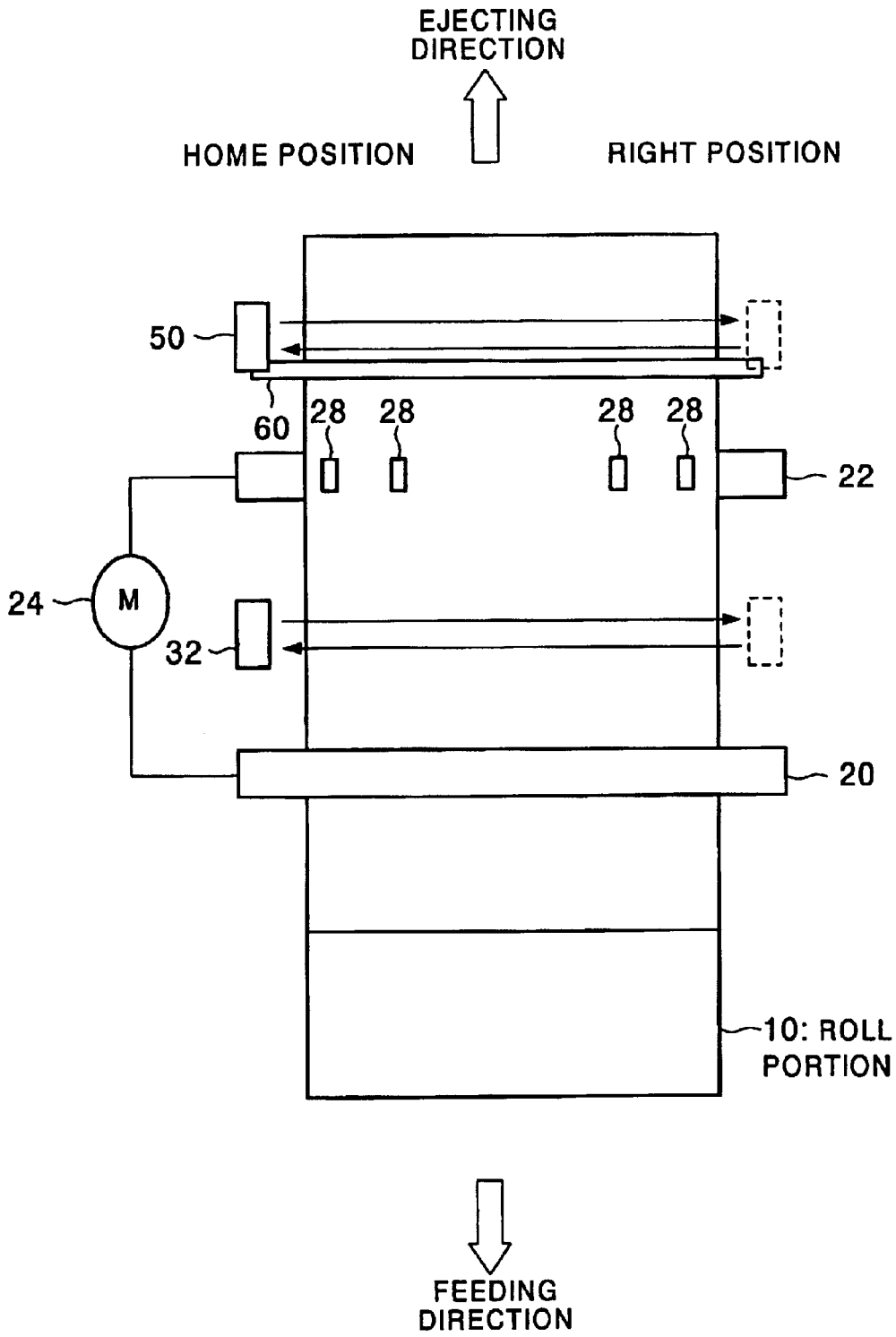
FIG. 2 is a schematic plan view for explaining the paper feed mechanism of the printer according to the embodiment of the present invention.

First referring to FIG. 1 and FIG. 2, a paper feed mechanism of the printer according to the embodiment is explained. FIG. 1 is a schematic diagram in a sectional direction for explaining the paper feed mechanism of the printer according to the embodiment, and FIG. 2 is a schematic diagram in plan view for explaining the same.

As shown in FIG. 1 and FIG. 2, the printer according to the embodiment is a printer capable of handling a roll paper as printing paper, and a roll portion 10 in which the printing paper is rolled is mounted in the printer. Then, one end of the printing paper is drawn out from the roll portion 10 to feed printing paper 12 on a paper path. In addition, in this embodiment, a direction where the printing paper 12 is sent out on the paper path is referred to as an ejecting direction, on the other hand, a direction where the printing paper 12 returns to the roll portion 10 is referred to as a feeding direction.

A rubber roller 20 and a rubber roller 22 are driven and rotate by themselves to move the printing paper 12 toward the ejecting direction and the feeding direction. That is, the rubber roller 20 and the rubber roller 22 are drivingly connected to a driving motor 24, and hence these rubber rollers 20 and 22 are driven when the driving motor 24 drives.

At a position of the rubber roller 20, the printing paper 12 is caught between the rubber roller 20 and a plastic supporter 26. Moreover, at a position of the rubber roller 22, the printing paper 12 is caught between the rubber roller 22 and notched rollers 28. Therefore, when the rubber rollers 20 and 22 rotate, the printing paper 12 moves toward the ejecting direction and the feeding direction by their friction. In this embodiment, making the printing paper 12 move toward the ejecting direction, the printer makes the driving motor 22 rotate clockwise, on the other hand, making the printing paper 12 move toward the feeding direction, the printer makes the driving motor 22 rotate counterclockwise.

The printing paper 12 is sent out from the position of the rubber roller 20 toward the ejection direction, so that ink is spouted to the printing paper 12 at a position of a print head 30 so as to produce a printed output. More specifically, the print head 30 is mounted on a carriage 32, and then a printing operation is performed with using the print head 30 by moving the carriage 32 from a home position to a right position and by moving it from the right position to the home position. During this movement, the print head 30 spouts the ink on a printing surface (top surface in FIG. 1) of the printing paper 12 to perform the printing operation.

Furthermore, the printing paper 12 is sent out on the paper path toward the ejecting direction, so that it reaches a position of the notched rollers 28. As shown in FIG. 1, in this embodiment, the notched rollers 28 have cut grooves like a gear shape on the periphery thereof to prevent a slip. In addition, as shown in FIG. 2, in this embodiment, the four notched rollers 28 are provided along the rubber roller 22.

Furthermore, the printing paper 12 is sent out from the notched rollers 28 toward the ejecting direction, so that it reaches a position of a cutter 50. The cutter 50 is provided with a cutting edge 54 for cutting the printing paper 12 and a cutting edge supporter 52. When the cutter 50 cuts the printing paper 12, the cutter 50 descends to a position shown by a dotted line in FIG. 1, so that the tip of the cutting edge 54 is under the printing paper 12. Under this condition, as shown in FIG. 2, the cutter 50 moves from the home position to the right position, so that the printing paper 12 is cut with the cutting edge 52.

Moreover, as shown in FIG. 1, a cutting paper holder 60 is provided in the feeding direction side of the cutter 50. When the printing paper 12 is moved toward the feeding direction and/or the ejecting direction during a normal print operation, the cutting paper holder 60 does not hold the printing paper 12 so as not to disturb the movement of the printing paper 12. That is, as shown in FIG. 1, the upper part of the cutting paper holder 60 is over the printing paper 12 and the lower part of the cutting paper holder 60 is under the printing paper 12, and they are separated from each other.

When the cutter 50 is moved from the home position to the right position to cut the printing paper 12, a gap between the upper part of the cutting paper holder 60 and the lower part of the cutting paper holder 60 sets smaller, so that they catch and hold the printing paper 12. As a result, the cutter 50 can smoothly cut the printing paper 12 without a swerve.

Figure 3:
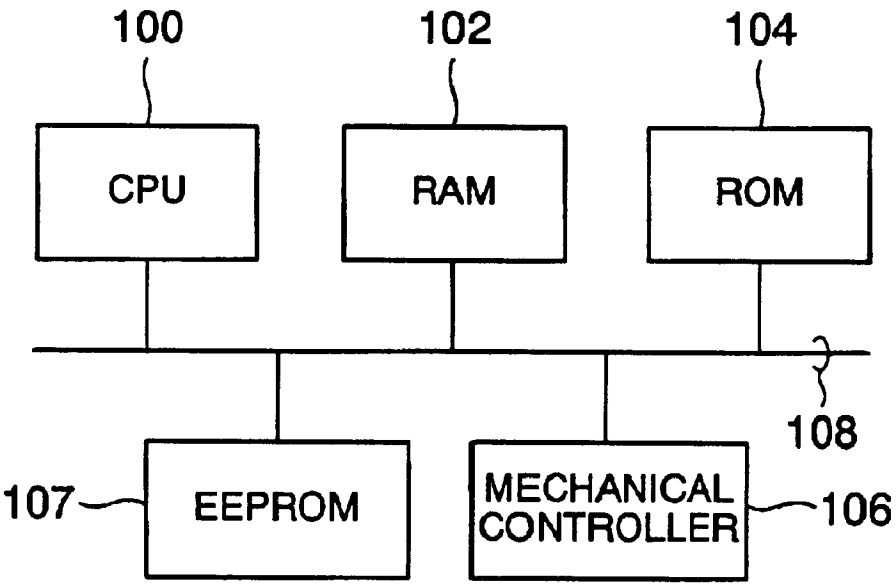
FIG. 3 is a block diagram for explaining a structure of a controller in the printer according to the embodiment.

Next referring to FIG. 3, a hardware structure of a controller of the printer according to the embodiment will be explained. FIG. 3 is a block diagram for showing the hardware structure of the controller such that the printer according to the embodiment controls mechanical parts shown in FIG. 1 and FIG. 2.

As shown in FIG. 3, the printer includes a CPU (Central Processing Unit) 100, a RAM (Random Access Memory) 102, a ROM (Read Only Memory) 104, a mechanical controller 106 and an EEPROM (Electrically Erasable Programmable ROM) 107, as the controller, and they are connected with each other via an internal bus 108. In addition, the CPU 100 constitutes a central processing unit in this embodiment, the RAM 102 constitutes a volatile memory device in this embodiment, the ROM 104 constitutes a nonvolatile memory device in this embodiment, and the EEPROM 107 constitutes an electrically rewritable nonvolatile memory device in this embodiment.

The CPU 100 reads out various programs which are stored in the RAM 102 and/or the ROM 104 and executes them. When it is necessary to operate and/or to stop the mechanical parts shown in FIG. 1 and FIG. 2, the CPU 100 sends such a command to the mechanical controller 106. The mechanical controller 106 performs necessary control of the mechanical parts on the basis of the received command. For example, when the mechanical controller 106 receives a command that makes the cutter 50 operate to cut the printing paper 12, the mechanical controller 106 generates necessary control signals for this purpose and moves the cutter 50 from the home position to the right position under conditions where the cutting paper holder 60 is holding the printing paper 12 in order to carry out a cutting operation. On the other hand, when the mechanical controller 106 receives a command that makes the driving motor 24 rotate in 600 steps in a clockwise direction, the mechanical controller 106 generates necessary control signals for this purpose and rotates the driving motor 24 in 600 steps in a clockwise direction.

In addition, in this embodiment, the number of the cleaning operation times is stored in the EEPROM 107. That is, the number of cleaning operation times for the notched rollers 28, the number of cleaning operation times for the cutting paper holder 60 and the number of cleaning operation times for the cutter 50 are stored in the EEPROM 107, respectively. As a result, it is possible to easily change the number of these cleaning operation times, respectively.

Figure 4:
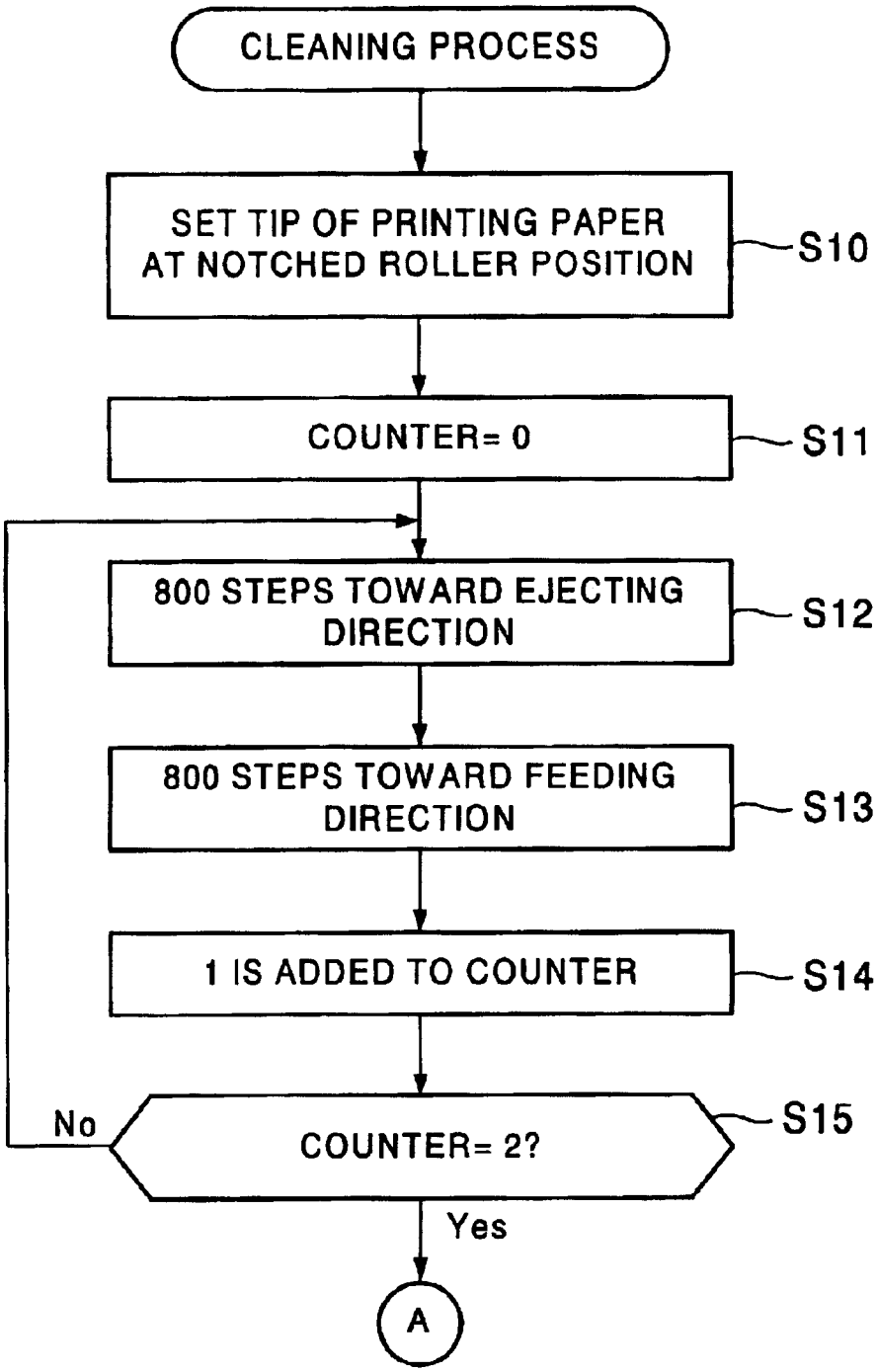
FIG. 4 is a diagram for showing a flowchart explaining a cleaning process which is executed in the printer according to the embodiment (the cleaning process for notched rollers)
Figure 5:
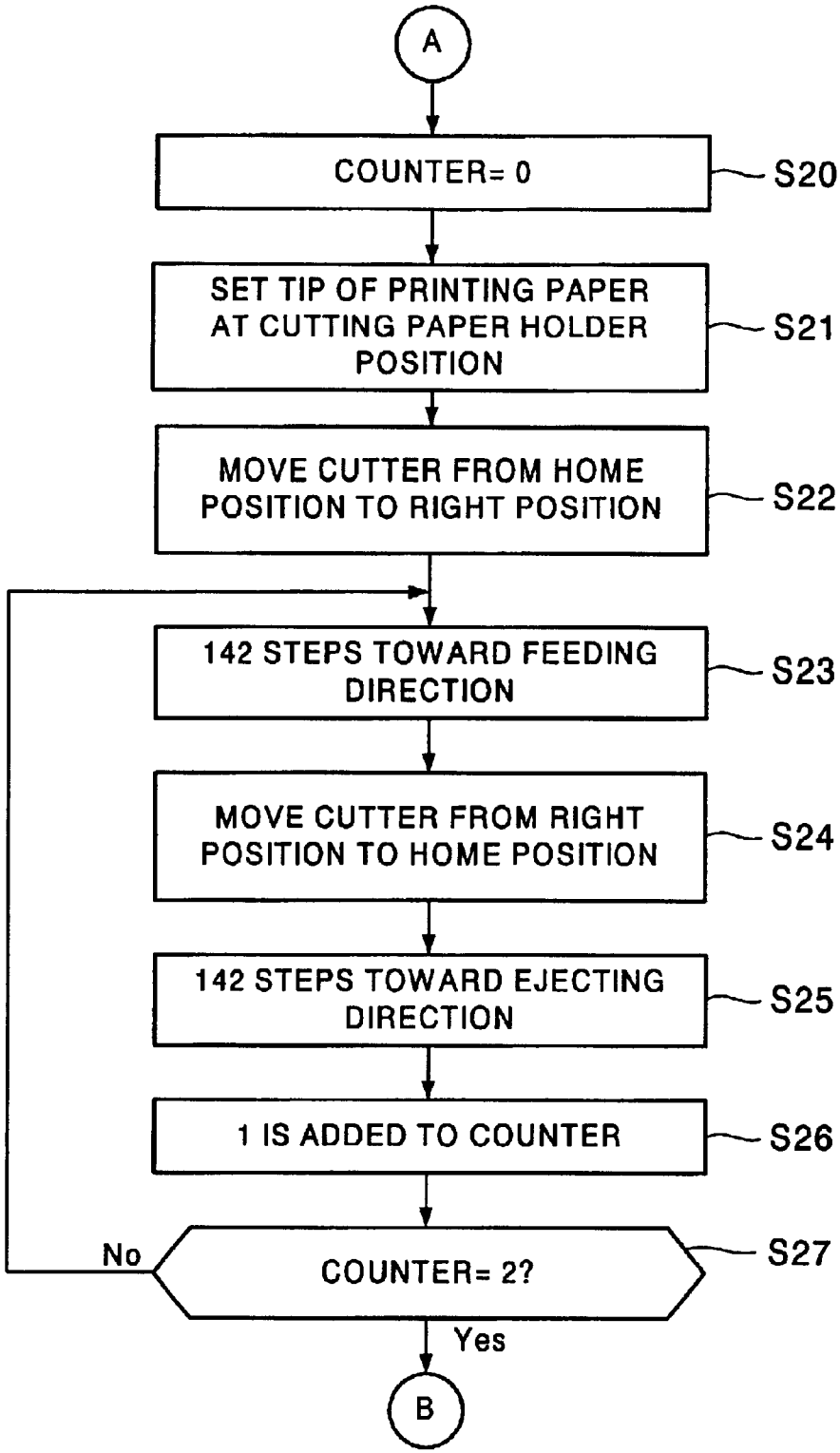
FIG. 5 is a diagram for showing a flowchart explaining the cleaning process which is executed in the printer according to the embodiment (the cleaning process for a cutting paper holder)
Figure 6:
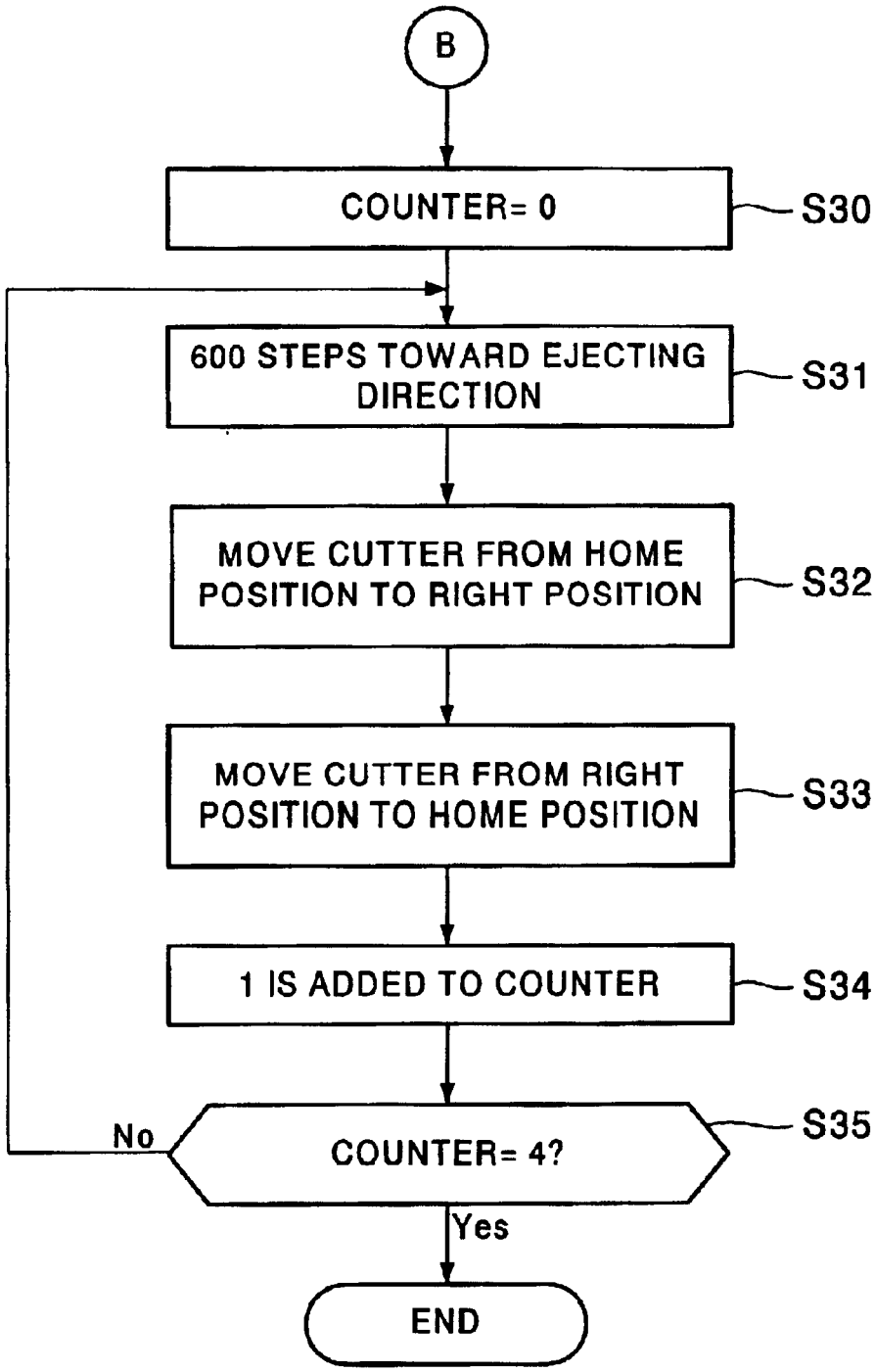
FIG. 6 is a diagram for showing a flowchart explaining the cleaning process which is executed in the printer according to the embodiment (the cleaning process for a cutter)

Next referring to FIG. 4 through FIG. 6, a cleaning process executed in the printer according to this embodiment will be explained. The CPU 100 reads and executes a cleaning process program stored in the RAM 102 or the ROM 104, so that the cleaning process shown in FIG. 4 through FIG. 6 is realized. Moreover, in this embodiment, the cleaning process is executed when a user changes an old roll paper into a new one. More specifically, in the printer according to this embodiment, the roll paper is inserted in a roll paper cassette, and then the roll paper cassette is set in the printer. The printer has a sensor for detecting whether the roll paper cassette is set or not. Then, when the user sets the roll paper cassette in the printer, the cleaning process is carried out along with a paper feeding operation, for example, after one minute.

In short, in the cleaning process, the printing paper 12 is moved in the back-and-forth directions twice at the position of the notched rollers 28 in the process shown in FIG. 4 in order to clean the notched rollers 28, and the printing paper 12 is extracted twice toward the feeding direction in the conditions where the cutting paper holder 60 is holding the printing paper 12 in the process shown in FIG. 5 in order to clean the cutting paper holder 60, and then the printing paper 12 is cut off with the cutter 50 in a long rectangular shape four times in the process shown in FIG. 6 in order to clean the cutting edge 54 of the cutter 50.

More specifically, as shown in FIG. 4, the printer sets the tip of the printing paper 12 at the position of the notched rollers 28 (Step S10). Thereby, the printing paper 12 is set at the position indicated by a solid line in FIG. 7. Then, a counter CT, which is a variable for counting the number of operation times, is set at zero (Step S11).

Next, the printer rotates the driving motor 24 in the clockwise direction in 800 steps in order to move the printing paper 12 toward the ejecting direction (Step S12). Subsequently, the printer rotates the driving motor 24 in counterclockwise direction in 800 steps in order to move the printing paper 12 toward the feeding direction (Step S13). Then, 1 is added to the counter CT (Step S14).

Next, the printer judges whether the counter CT is 2 or not (Step S15). If the counter CT does not become 2 (Step S15: No), i.e. the printer has not carried out the back-and-forth movement of the printing paper 12 twice yet, then the process from Step 12 mentioned above is repeated. If the counter CT is 2 (Step S15: Yes), then it means that the printer has carried out the back-and-forth movement of the printing paper 12 twice, so that the printer proceeds to the process shown in FIG. 5. Moreover, as mentioned above, the number which is compared with the counter CT in Step S15, i.e. the number of times of the back-and-forth movement of the printing paper 12, is stored in the EEPROM 107. Therefore, in Step 15, the printer reads out a value stored in the EEPROM 107 and compares the value with the counter CT.

Figure 7:
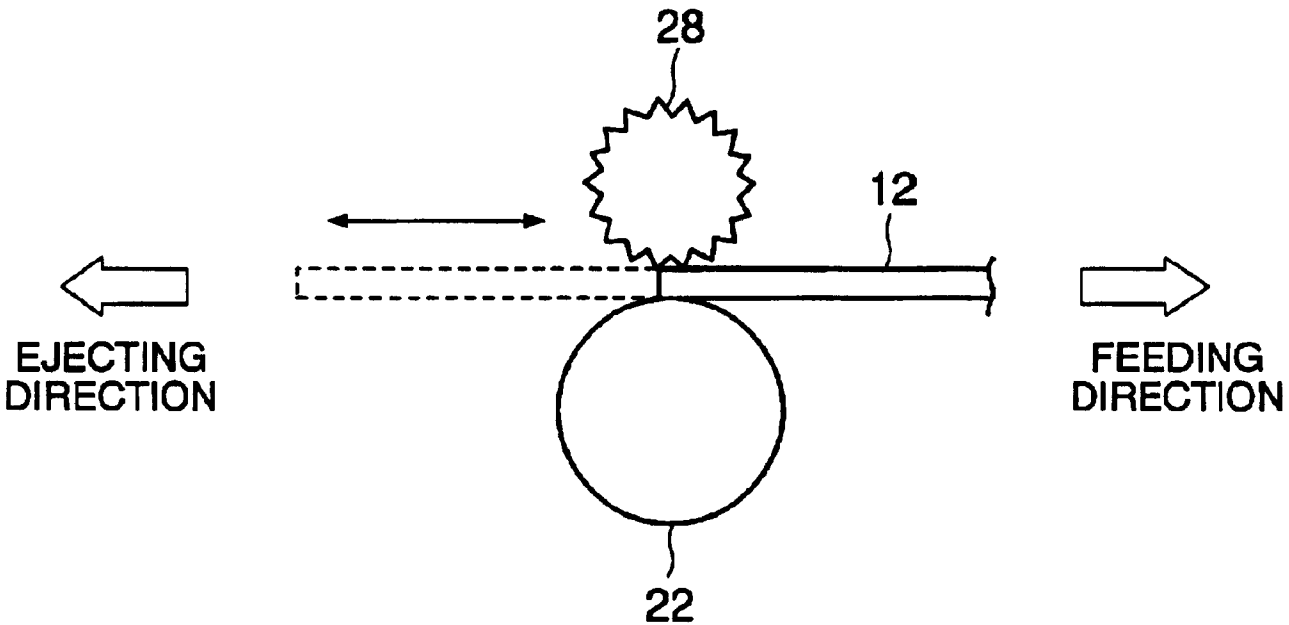
FIG. 7 is an enlarged diagram for explaining a state of the cleaning process around the notched rollers.

In the process of Step 10 through Step 15 in FIG. 4, the back-and-forth movement operation for the printing paper 12 is carried out as shown in FIG. 7. That is, after the printer sets the tip of the new printing paper 12 in the ejecting direction at the position of the notched rollers 28, the printer performs the operations, in each of which the printer moves the printing paper 12 toward the ejecting direction in 800 steps and then returns it in 800 steps, twice. Thereby, the dirt on the printing paper face of the notched rollers 28 can be cleaned by smearing the dirt on the tip portion of the printing paper 12 in the ejecting direction.

Figure 8:
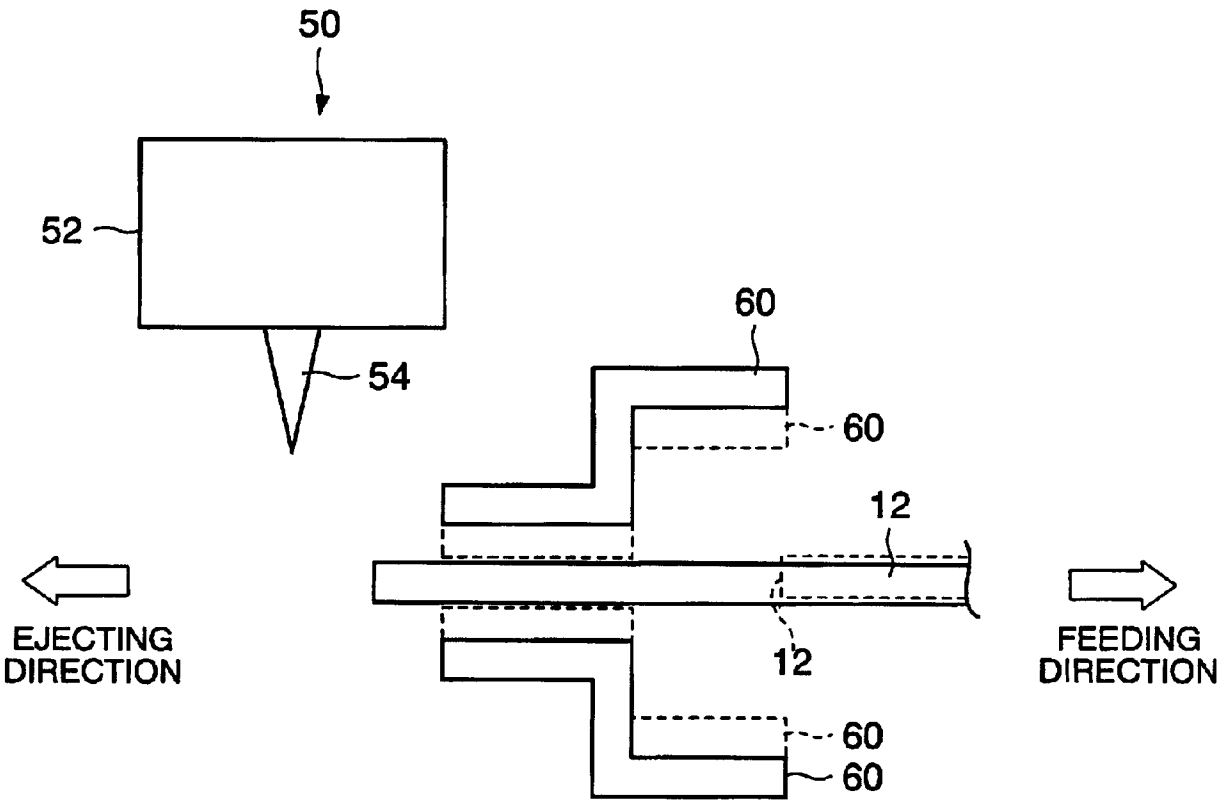
FIG. 8 is an enlarged diagram for explaining a state of the cleaning process around the cutting paper holder.

Next, as shown in FIG. 5, the printer resets the counter CT at zero (Step S20). Subsequently, the printer sets the tip of the printing paper 12 in the ejecting direction at the position of the cutting paper holder 60 (Step S21). Thereby, the printing paper 12 proceeds to the position indicated by a solid line in FIG. 8. That is, the printing paper 12 stops at the position where the tip thereof is in the ejecting direction side of the ejecting direction end of the cutting paper holder 60 and where the tip thereof is in the feeding direction side of the cutting edge 54 of the cutter 50. Since the tip of the printing paper 12 in the ejecting direction is set at this position, it is possible not to actually cut the printing paper 12 even though a pseudo cutting operation is performed with cutter 50.

Next, the printer moves the cutter 50 from the home position to the right position (Step S22). Thereby, the pseudo cutting operation of the cutter 50 is carried out, so that the cutting paper holder 60 catches and holds the tip portion of the printing paper 12 as indicated by a dotted line in FIG. 8. Subsequently, the printer rotates the driving motor 24 in 142 steps to the counterclockwise direction so as to move the printing paper 12 toward the feeding direction (Step S23). Thereby, the printing paper 12 is pulled toward the feeding direction, so that the printing paper 12 moves up to the position indicated by a dotted line in FIG. 8 in the conditions where the cutting paper holder 60 is catching and holding the tip portion of the printing paper 12. As a result of this operation, the cutting paper holder 60 can be cleaned by smearing the dirt of the cutting paper holder 60 on the printing paper 12.

Next, the printer moves the cutter 50 from the right position to the home position (Step S24). Thereby, the cutting paper holder 60 is in conditions where it does not catch the printing paper 12 as indicated by the solid line in FIG. 8. Subsequently, the printer rotates the driving motor 24 in 142 steps to the clockwise direction so as to move the printing paper 12 in 142 steps toward the ejection direction (Step S25). Thereby, the printing paper 12 returns to the position indicated by the solid line in FIG. 8.

Next, the printer adds 1 to the counter CT (Step S26). Subsequently, the printer judges whether the counter CT is 2 or not (Step S27). If the counter does not become 2 (Step S27: No), i.e. the printer has not carried out the cleaning operation of the cutting paper holder 60 twice yet, then the process from Step 21 mentioned above is repeated. On the other hand, if the counter CT is 2 (Step 27: Yes), i.e. the printer has carried out the cleaning operation of the cutting paper holder 60 twice, then the printer proceeds to the process shown in FIG. 6. As mentioned above, the number which is compared with the counter CT in Step S27, i.e. the number of cleaning times of the cutting paper holder 60, is stored in the EEPROM 107. Therefore, in Step 27, the printer reads out a value stored in the EEPROM 107 and compares the value with the counter CT.

Figure 9:
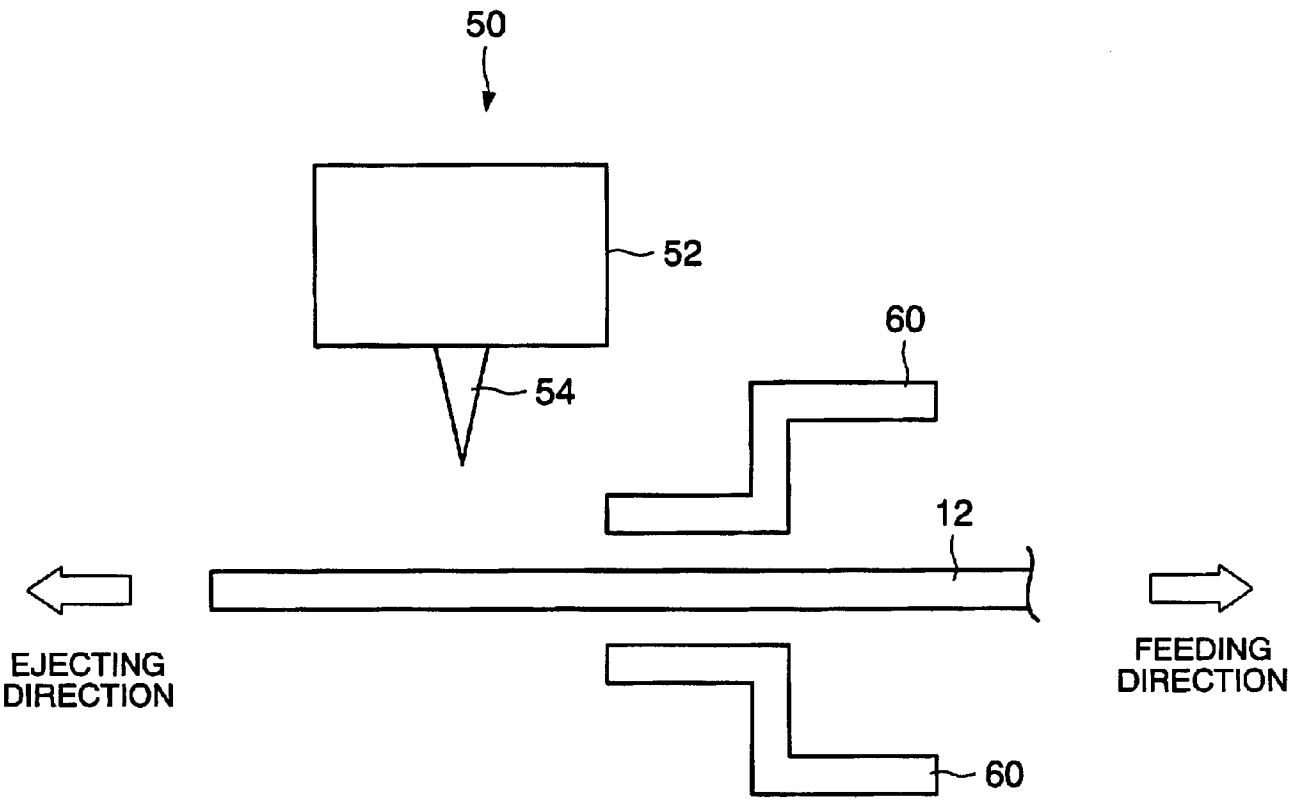
FIG. 9 is an enlarged diagram for explaining a state of the cleaning process around the cutter.

Next, as shown in FIG. 6, the printer resets the counter CT at zero (Step S30). Subsequently, the printer rotates the driving motor 24 in 600 steps to the clockwise direction so as to move the printing paper 12 in 600 steps toward the ejecting direction (Step S31). Thereby, the printing paper 12 proceeds to a position shown in FIG. 9. That is, the tip portion of the printing paper 12 in the ejection direction moves at the position of the cutter 50, and then the tip of the printing paper 12 is in the ejecting direction side of the cutting edge 54 of the cutter 50.

Next, the printer moves the cutter 50 from the home position to the right position in order to cut the printing paper 12 (Step S32). As a result of this operation, it is possible to smear the dirt, which sticks on the cutting edge 54 of the cutter 50, on the printing paper 12 on which the dirt does not stick. Subsequently, the printer moves the cutter 50 from the right position to the home position in order that the cutter 50 returns (Step S33).

Next, the printer adds 1 to the counter CT (Step S34). Subsequently, the printer judges whether the counter CT is 4 or not (Step S35). If the counter does not become 4 (Step S35: No), i.e. the printer has not carried out the cleaning operation of the cutter 50 four times yet, then the process from Step S31 mentioned above is repeated. On the other hand, if the counter CT is 4 (Step 35: Yes), i.e. the printer has carried out the cleaning operation of the cutter 50 four times, then the cleaning process is completed. As mentioned above, the number which is compared with the counter CT in Step S35, i.e. the number of times the printing paper 12 is cut, is stored in the EEPROM 107. Therefore, in Step 35, the printer reads out a value stored in the EEPROM 107 and compares the value with the counter CT.

As explained above, the printer according to the embodiment cleans the notched rollers 28 and the rubber roller 22, which rotate when the printing paper 12 moves, by moving the printing paper 12 toward the ejecting direction and the feeding direction. After that, the printer cleans the cutting paper holder 60 by moving the printing paper 12 toward the feeding direction under conditions where the cutting paper holder 60 is holding the tip of the printing paper 12. After that, the printer cleans the cutting edge 54 by cutting the printing paper 12 with the cutter 50 under conditions where the tip of the printing paper 12 is at the position of the cutter 50. Therefore, if the user does not take any action, it is possible to clean these portions. There is a possibility that the ink spouted from the print head 30 on the printed face, which is the upper face of the printing paper 12 in FIG. 1, has not dried yet. Therefore, it is especially noted that the dirt easily sticks on the notched rollers 28 and the cutting paper holder 60 because they are on the printed face of the printing paper 12. This matter is also applied to the cutting edge 54 of the cutter 50 which cuts the printing paper 12. However, the printer can smear the ink dirt on the printing paper 12 in the cleaning sequence to clean them.

Moreover, in this embodiment, the notched rollers 28, the rubber roller 22 and the cutting paper holder 60 are cleaned with using the tip of the printing paper 12 in the ejecting direction, and then the tip of the printing paper 12 is cut off in order to clean the cutter 50. In other words, the cleaning for the cutter 50 which is performed by cutting the printing paper 12 is the last process of the series of the sequences. Therefore, it is possible to shorten the length of the printing paper 12 which is used in the cleaning in the feeding direction.

In this case, it is necessary that the total length of the printing paper 12 which is cut off in the cleaning for the cutter 50 is longer than the length of the printing paper 12 which is used in the cleaning for the notched rollers 28, the rubber roller 22 and the cutting paper holder 60.

Furthermore, in the printer according to the embodiment, the cutting paper holder 60 is provided in the feeding direction side of the cutting edge 54 of the cutter 50, whereas it is not provided in the ejecting direction side of the cutting edge 54 of the cutter 50. As a result, in the cleaning process for the cutting paper holder 60 shown in FIG. 5 and FIG. 8, the printer moves the cutter 50 from the home position to the right position so as to perform the pseudo cutting operation, thereby the printer can make the conditions where the cutting paper holder 50 is holding the printing paper 12.

In addition, the present invention is not limited to the embodiment explained above, but various changes or modifications are possible. For example, the cleaning process mentioned above is carried out when the user changes the roll paper in the above-explained embodiment, but the timing of the cleaning process is not limited to this. For instance, the printer may carry out the cleaning process when the user sends a cleaning command from a computer which is connected to this printer.

Furthermore, in the embodiment mentioned above, the printer moves the printing paper 12 in the back-and-forth directions twice in order to clean the notched rollers 28, and the printer moves the printing paper 12 toward the feeding direction twice in the situations where the cutting paper holder 60 is holding the printing paper 12 in order to clean the cutting paper holder 60, and then the printer cuts off the printing paper 12 in a long rectangular shape four times in order to clean the cutting edge 54 of the cutter 50. However, the number of times the printing paper 12 is moved and the number of times the printing paper is cut are not limited to the example above. Each of the number of times can be one or more to clean the dirt by smearing.

Figure 10:
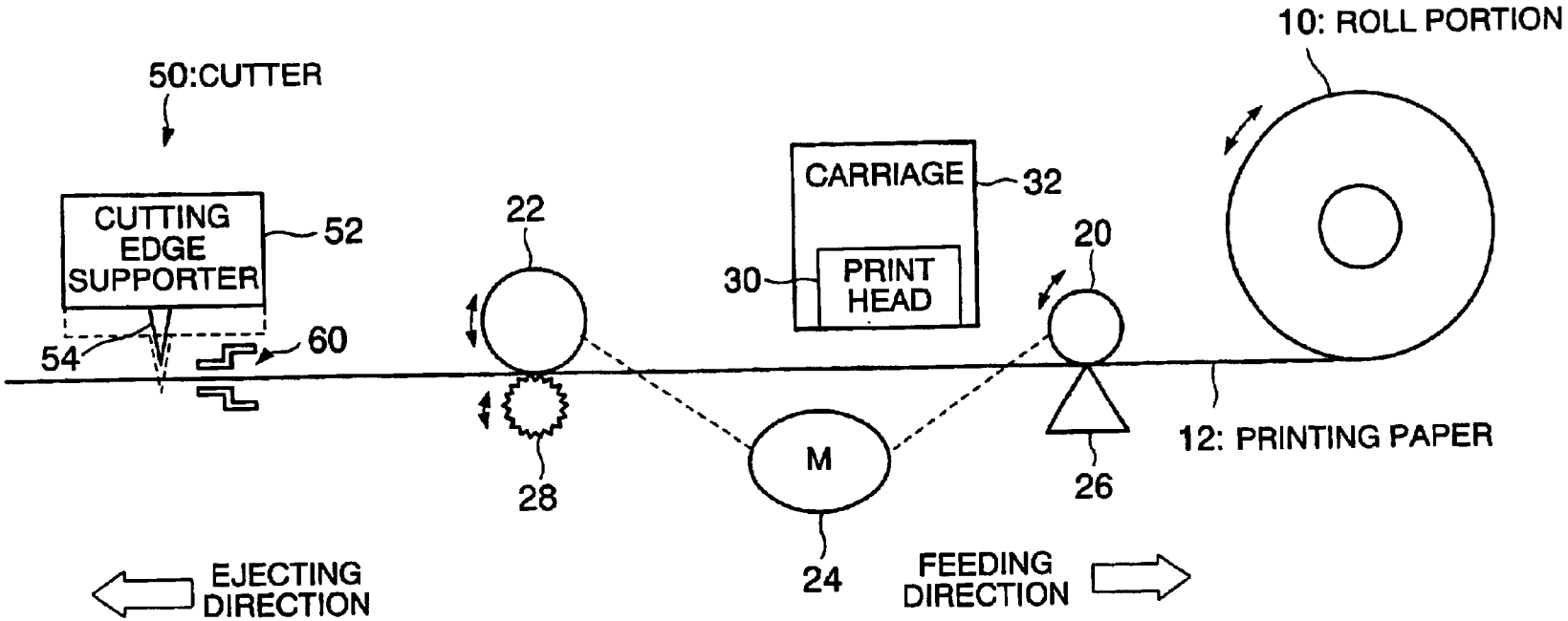
FIG. 10 is a schematic diagram which explains a printer according to another embodiment of the present invention and which corresponds to FIG. 1.
Figure 11:
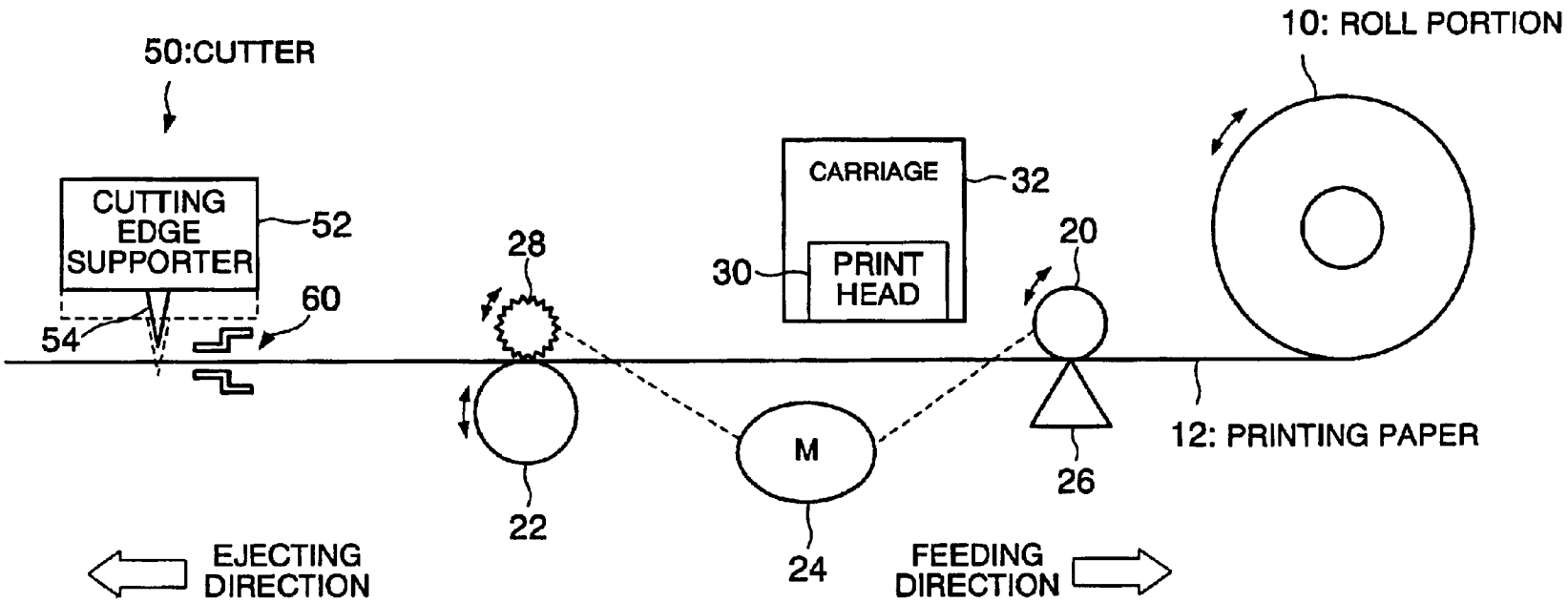
FIG. 11 is a schematic diagram which explains a printer according to still another embodiment of the present invention and which corresponds to FIG. 1.

In addition, in the embodiment mentioned above, it is explained that the notched rollers 28 do not rotate by themselves but they are rotated in accordance with the movement of the printing paper 12, and that the rubber roller 22 does rotate by itself so as to move the printing paper 12 in the ejection direction and the feeding direction. However, functions and combinations are not limited to this example. For example, as shown in FIG. 10, the notched rollers 28 may be provided under the printing paper 12 and the rubber roller 22 may be provided over the printing paper 12. On the other hand, as shown in FIG. 11, the notched rollers 28 may rotate by themselves in order to move the printing paper 12 in the ejecting direction and the feeding direction. Moreover, the kind of roller which rotates in order to move the printing paper 12 is not limited to the notched roller or the rubber roller, but various kinds of roller can be used.

In the embodiment discussed above, the cleaning for the notched rollers 28, the cleaning for the cutting paper holder 60 and the cleaning for the cutter 50 are carried out in one cleaning process, but it is not necessarily to carry out these three cleanings in the single cleaning process. For instance, in the single cleaning process, only the cleaning for the cutter 50 may be carried out, the cleaning for the cutter 50 and the cleaning for the notched rollers 28 may be carried out, or the cleaning for the cutter 50 and the cleaning for the cutting paper holder 60 may be carried out. In other words, it is possible to selectively perform an optional cleaning in the single cleaning process.

In the embodiment discussed above, the ink jet printer which is connected to a computer was explained as one example of the ink type recording device. However, the present invention can be also applied to another device of the ink type recoding device. In addition, a printing medium is not limited to the printing paper 12, but the printing medium may be an OHP sheet and so on.

Furthermore, regarding respective kinds of process explained in the above embodiment, programs for executing the process can be recorded in a recording medium such as a flexible disk, a CD-ROM (compact disc read only memory) or a memory card, and the programs can be distributed in form of the recording medium. In this case, the embodiment can be realized by having the printer read the programs stored in the recording medium and having the printer execute the programs.

The printer may be equipped with other programs such as an operating system or other application programs. In this case, efficiently using the own programs of the printer, only the instructions for calling programs from the own programs of the printer, which realize process equivalent to the process of the embodiment, may be recorded on the recording medium.

These programs can be distributed also as a carrier wave through a network, but not in the form of the recording medium. Programs transmitted in the form of the carrier wave on the network can be taken into the printer and then the programs are executed to realize the above-explained embodiment.

When programs are recorded on the recording medium or transmitted as a carrier wave through the network, the programs may be encrypted and/or compressed. In this case, the printer having read in the programs from the recording medium or the carrier wave must decrypt and/or expand the programs prior to execution.

What is claimed is:

1. An ink type recording device, comprising:

a printing medium mover which moves a printing medium toward a first direction and a second direction which is opposite to the first direction;

a print head which spouts ink to the printing medium in order to produce a printed output on the printing medium;

a cutter which is provided in the first direction side of the print head and which cuts the printing medium;

a cutter cleaning executor which moves the printing medium by using the printing medium mover so that the tip of the printing medium in the first direction is at a position of the cutter and which cuts the printing medium with the cutter at least once in order to clean the cutter;

a roller which is provided in the first direction side of the print head and which rotates when the printing medium mover moves the printing medium; and a roller cleaning executor which moves the printing medium by using the printing medium mover so that the tip of the printing medium in the first direction is at a position of the roller and which moves the printing medium toward the first direction and the second direction at least once in order to clean the roller.

2. The ink type recording device as set forth in claim 1, wherein the roller does not rotate by itself, but it is rotated by friction of the printing medium in accordance with movement of the printing medium by using the printing medium mover.

3. The ink type recording device as set forth in claim 1, wherein the roller rotates by itself so as to move the printing medium toward the first direction and the second direction, as the printing medium mover.

4. The ink type recording device as set forth in claim 1, further comprising:

a cutting medium holder which is provided in the first direction side of the print head and which holds the printing medium when the cutter cuts the printing medium; and a cutting medium holder cleaning executor which moves the printing medium by using the printing medium mover so that the tip of the printing medium in the first direction is at a position of the cutting medium holder and which moves the printing medium toward the second direction at least once under conditions where the cutting medium holder is holding the printing medium in order to clean the cutting medium holder.

5. The ink type recording device as set forth in claim 4, wherein the passing order of the printing medium is the roller, the cutting medium holder and the cutter.

6. The ink type recording device as set forth in claim 5, wherein the total length of the printing medium which is cut with the cutter cleaning executor is longer than the length of the printing medium which is used by the roller cleaning executor and the cutting medium holder cleaning executor, in the second direction.

7. The ink type recording device as set forth in claim 5, wherein the cutting medium holder is provide in the second direction side of a cutting edge of the cutter, but it is not provided in the first direction side of the cutting edge of the cutter.

8. The ink type recording device as set forth in claim 5, wherein when the cutting medium holder cleaning executor moves the printing medium by using the printing medium mover so that the tip of the printing medium in the first direction is at the position of the cutting medium holder, the cutting medium holder cleaning executor moves the print medium so that the tip of the printing medium is in the first direction side of the cutting medium holder and it is in the second direction side of a cutting edge of the cutter.

9. The ink type recording device as set forth in claim 5, wherein the printing medium is a roll paper in which paper is rolled, and the roller cleaning executor, the cutting medium holder cleaning executor and the cutter cleaning executor carry out their cleaning process when the roll paper is changed.

10. The ink type recording device as set forth in claim 5, wherein the number of times the roller cleaning executor moves the printing medium toward the first direction and the second direction, the number of times the cutting medium holder cleaning executor moves the printing medium toward the second direction under the conditions where the cutting medium holder is holding the printing medium, and the number of times the cutter cleaning executor cuts the printing medium are stored in an electrically rewritable nonvolatile memory device.

11. An ink type recording device, comprising:

a printing medium mover which moves a printing medium toward a first direction and a second direction which is opposite to the first direction;

a print head which spouts ink to the printing medium in order to produce a printed output on the printing medium;

a cutter which is provided in the first direction side of the print head and which cuts the printing medium;

a cutter cleaning executor which moves the printing medium by using the printing medium mover so that the tip of the printing medium in the first direction is at a position of the cutter and which cuts the printing medium with the cutter at least once in order to clean the cutter;

a cutting medium holder which is provided in the first direction side of the print head and which holds the printing medium when the cutter cuts the printing medium; and a cutting medium holder cleaning executor which moves the printing medium by using the printing medium mover so that the tip of the printing medium in the first direction is at a position of the cutting medium holder and which moves the printing medium toward the second direction at least once under conditions where the cutting medium holder is holding the printing medium.

12. The ink type recording device as set forth in claim 11, wherein the cutting medium holder is provided in the second direction side of a cutting edge of the cutter, but it is not provided in the first direction side of the cutting edge of the cutter.

13. The ink type recording device as set forth in claim 11, wherein when the cutting medium holder cleaning executor moves the printing medium by using the printing medium mover so that the tip of the printing medium in the first direction is at the position of the cutting medium holder, the cutting medium holder cleaning executor moves the print medium so that the tip of the printing medium is in the first direction side of the cutting medium holder and it is in the second direction side of a cutting edge of the cutter.

14. The ink type recording device as set forth in claim 11, wherein the printing medium is a roll paper in which paper is rolled, and the cutting medium holder cleaning executor and the cutter cleaning executor carry out their cleaning process when the roll paper is changed.

15. The ink type recording device as set forth in claim 11, wherein the number of times the cutting medium holder cleaning executor moves the printing medium toward the second direction under the conditions where the cutting medium holder is holding the printing medium, and the number of times the cutter cleaning executor cuts the printing medium are stored in an electrically rewritable nonvolatile memory device.

16. A method for cleaning control of an ink type recording device which includes a print head for spouting ink to a printing medium in order to produce a printed output on the printing medium and a cutter which is provided in a first direction side of the print head and which cuts the printing medium, the method comprising the steps of:

moving the printing medium toward the first direction so that the tip of the printing medium in the first direction is at a position of the cutter; and cutting the printing medium at least once in order to clean the cutter, wherein the ink type recording device further comprises a roller which is provided in the first direction side of the print head and which rotates when the printing medium mover moves the printing medium, wherein the method further comprises the steps of:

moving the printing medium so that the tip of the printing medium in the first direction is at a position of the roller; and moving the printing medium toward the first direction and a second direction at least once in order to clean the roller, the second direction being opposite to the first direction.

17. The method for the cleaning control of the ink type recording device as set forth in claim 16, wherein the ink type recording device further comprises a cutting medium holder which is provided in the first direction side of the print head and which holds the printing medium when the cutter cuts the printing medium, wherein the method further comprises the steps of:

moving the printing medium so that the tip of the printing medium in the first direction is at a position of the cutting medium holder; and moving the printing medium toward the second direction at least once under conditions where the cutting medium holder is holding the printing medium in order to clean the cutting medium holder.

18. The method for the cleaning control of the ink type recording device as set forth in claim 17, wherein the passing order of the printing medium is the roller, the cutting medium holder and the cutter.

19. The method for the cleaning control of the ink type recording device as set forth in claim 18, wherein the total length of the printing medium which is cut in the step of cutting the printing medium is longer than the length of the printing medium which is used in the step of moving the printing medium in order to clean the roller and in the step of the moving the printing medium in order to clean the cutting medium holder, in the second direction.

20. The method for the cleaning control of the ink type recording device as set forth in claim 18, wherein the cutting medium holder is provided in the second direction side of a cutting edge of the cutter, but it is not provided in the first direction side of the cutting edge of the cutter.

21. The method for the cleaning control of the ink type recording device as set forth in claim 18, wherein the step of moving the printing medium so that the tip of the printing medium in the first direction is at the position of the cutting medium holder comprises the step of:

moving the printing medium so that the tip of the printing medium is in the first direction side of the cutting medium holder and it is in the second direction side of a cutting edge of the cutter.

22. The method for the cleaning control of the ink type recording device as set forth in claim 18, wherein the printing medium is a roll paper in which paper is rolled, and the method is carried out when the roll paper is changed.

23. A method for cleaning control of an ink type recording device which includes a print head for spouting ink to a printing medium in order to produce a printed output on the printing medium and a cutter which is provided in a first direction side of the print head and which cuts the printing medium, the method comprising the steps of:

moving the printing medium toward the first direction so that the tip of the printing medium in the first direction is at a position of the cutter; and cutting the printing medium at least once in order to clean the cutter, wherein the ink type recording device further comprises a cutting medium holder which is provided in the first direction side of the print head and which holds the printing medium when the cutter cuts the printing medium, wherein the method further comprises the steps of:

moving the printing medium so that the tip of the printing medium in the first direction is at a position of the cutting medium holder; and moving the printing medium toward a second direction at least once under conditions where the cutting medium holder is holding the printing medium in order to clean the cutting medium holder, the second direction being opposite to the first direction.

24. The method for the cleaning control of the ink type recording device as set forth in claim 23, wherein the cutting medium holder is provided in the second direction side of a cutting edge of the cutter, but it is not provided in the first direction side of the cutting edge of the cutter.

25. The method for the cleaning control of the ink type recording device as set forth in claim 23, wherein the step of moving the printing medium so that the tip of the printing medium in the first direction is at the position of the cutting medium holder comprises the step of:

moving the printing medium so that the tip of the printing medium is in the first direction side of the cutting medium holder and it is in the second direction side of a cutting edge of the cutter.

26. The method for the cleaning control of the ink type recording device as set forth in claim 23, wherein the printing medium is a roll paper in which paper is rolled, and the method is carried out when the roll paper is changed.

27. An ink type recording device, comprising:

a printing medium mover which moves a printing medium toward a first direction and a second direction which is opposite to the first direction;

a print head which spouts ink to the printing medium in order to produce a printed output on the printing medium;

a cutter which is provided in the first direction side of the print head and which cuts the printing medium;

a cutter cleaning executor which moves the printing medium by using the printing medium mover so that the tip of the printing medium in the first direction is at a position of the cutter and which cuts the printing medium with the cutter at least once in order to clean the cutter using only the printing medium;

a roller which is provided in the first direction side of the print head and which rotates when the printing medium mover moves the printing medium; and a roller cleaning executor which moves the printing medium by using the printing medium mover so that the tip of the printing medium in the first direction is at a position of the roller and which moves the printing medium toward the first direction and the second direction at least once in order to clean the roller.

28. An ink type recording device, comprising:

a printing medium mover which moves a printing medium toward a first direction and a second direction which is opposite to the first direction;

a print head which spouts ink to the printing medium in order to produce a printed output on the printing medium;

a cutter which is provided in the first direction side of the print head and which cuts the printing medium;

a cutter cleaning executor which moves the printing medium by using the printing medium mover so that the tip of the printing medium in the first direction is at a position of the cutter and which cuts the printing medium with the cutter at least once in order to clean the cutter using only the printing medium;

a cutting medium holder which is provided in the first direction side of the print head and which holds the printing medium when the cutter cuts the printing medium; and a cutting medium holder cleaning executor which moves the printing medium by using the printing medium mover so that the tip of the printing medium in the first direction is at a position of the cutting medium holder and which moves the printing medium toward the second direction at least once under conditions where the cutting medium holder is holding the printing medium.

29. A method for cleaning control of an ink type recording device which includes a print head for spouting ink to a print medium in order to produce a printed output on the printing medium and a cutter which is provided in a first direction side of the print head and which cuts the printing medium, the method comprising:

moving the printing medium toward the first direction so that the tip of the printing medium in the first direction is at a position of the cutter; and cutting the printing medium at least once in order to clean the cutter using only the printing medium, wherein the ink type recording device further comprises a roller which is provided in the first direction side of the print head and which rotates when the printing medium mover moves the printing medium, wherein the method further comprises, moving the printing medium so that the tip of the printing medium in the first direction is at a position of the roller; and moving the printing medium toward the first direction and a second direction at least once in order to clean the roller, the second direction being opposite to the first direction.

30. A method for cleaning control of an ink type recording device which includes a print head for spouting ink to a print medium in order to produce a printed output on the printing medium and a cutter which is provided in a first direction side of the print head and which cuts the printing medium, the method comprising:

moving the printing medium toward the first direction so that the tip of the printing medium in the first direction is at a position of the cutter; and cutting the printing medium at least once in order to clean the cutter using only the printing medium, wherein the ink type recording device further comprises a cutting medium holder which is provided in the first direction side of the print bead and which holds the printing medium when the cutter cuts the printing medium, wherein the method further comprises, moving the printing medium so that the tip of the printing medium in the first direction is at a position of the cutting medium holder; and moving the printing medium toward a second direction at least once under conditions where the cutting medium holder is holding the printing medium in order to clean the cutting medium holder, the second direction being opposite to the first direction.

* * * * *